US005384160A

United States Patent [19]

Frazzitta

[11] Patent Number: 5,384,160

[45] Date of Patent: Jan. 24, 1995

[54] METHOD OF COATING A SURFACE

[76] Inventor: Joseph Frazzitta, 279 Cherry Pl., East Meadow, N.Y. 11554

[21] Appl. No.: 29,681

[22] Filed: Mar. 11, 1993

[51] Int. Cl.[6] ..... B05D 1/36; B05D 5/00

[52] U.S. Cl. ..... 427/288; 427/208.2; 427/208.5; 427/258; 427/314; 427/316; 427/407.1; 427/411

[58] Field of Search ..... 427/208.2, 208.5, 258, 427/288, 314, 316, 407.1, 411

[56] References Cited

U.S. PATENT DOCUMENTS

| | | | |
|---|---|---|---|
| 3,998,160 | 12/1976 | Pearce . | |
| 4,064,804 | 12/1977 | Schweitzer . | |
| 4,170,681 | 10/1979 | Edwards et al. | 427/258 |
| 4,281,332 | 7/1981 | Horike . | |
| 4,518,634 | 5/1985 | Gini et al. . | |
| 4,595,611 | 6/1986 | Quick et al. | 427/258 |
| 4,670,307 | 6/1987 | Onishi et al. . | |
| 4,797,692 | 1/1989 | Ims . | |
| 4,844,952 | 7/1989 | Korenkiewicz et al. | 427/258 |
| 4,859,723 | 8/1989 | Kyminas et al. | 427/258 |
| 4,860,027 | 8/1989 | Ozelis et al. . | |
| 5,021,802 | 6/1991 | Allred . | |
| 5,032,424 | 7/1991 | Carlson et al. | 427/258 |
| 5,041,161 | 8/1991 | Cooke et al. . | |
| 5,112,398 | 5/1992 | Kruse . | |
| 5,114,478 | 5/1992 | Auslander et al. . | |

FOREIGN PATENT DOCUMENTS

| | | | |
|---|---|---|---|
| 3247677 | 6/1984 | Germany | 427/258 |

*Primary Examiner*—Asok Pal

*Attorney, Agent, or Firm*—Henry D. Coleman; R. Neil Sudol

[57] ABSTRACT

A method for depositing an aqueous coating composition onto an ink layer or uninked surface in a printing process comprising (1) depositing a first layer of the ink onto a surface to be coated, (2) drying said ink layer, (3) determining a desired viscosity of an aqueous coating composition to be deposited onto said ink layer or said surface, said composition comprising (a) about 15–85% by weight of a film-forming polymer, said film forming polymer comprising 10–90% by weight of a high molecular weight polymer of an average molecular weight of about 30,000 to about 5,000,000 and 10–90% by weight of a low molecular weight polymer of average molecular weight of about 100 to about 20,000, (b) an amount of wetting agent effective to substantially eliminate levelling problems after deposition caused by surface tension, and (c) the remainder comprising a mixture of water and optionally a volatile organic solvent. (4) determining the temperature above or below ambient temperature at which said composition attains the viscosity previously determined, (5) maintaining the desired viscosity of said composition at the temperature determined earlier and (6) depositing the aqueous coating composition at the determined temperature onto said ink layer or said surface.

42 Claims, 1 Drawing Sheet

FIG. 1
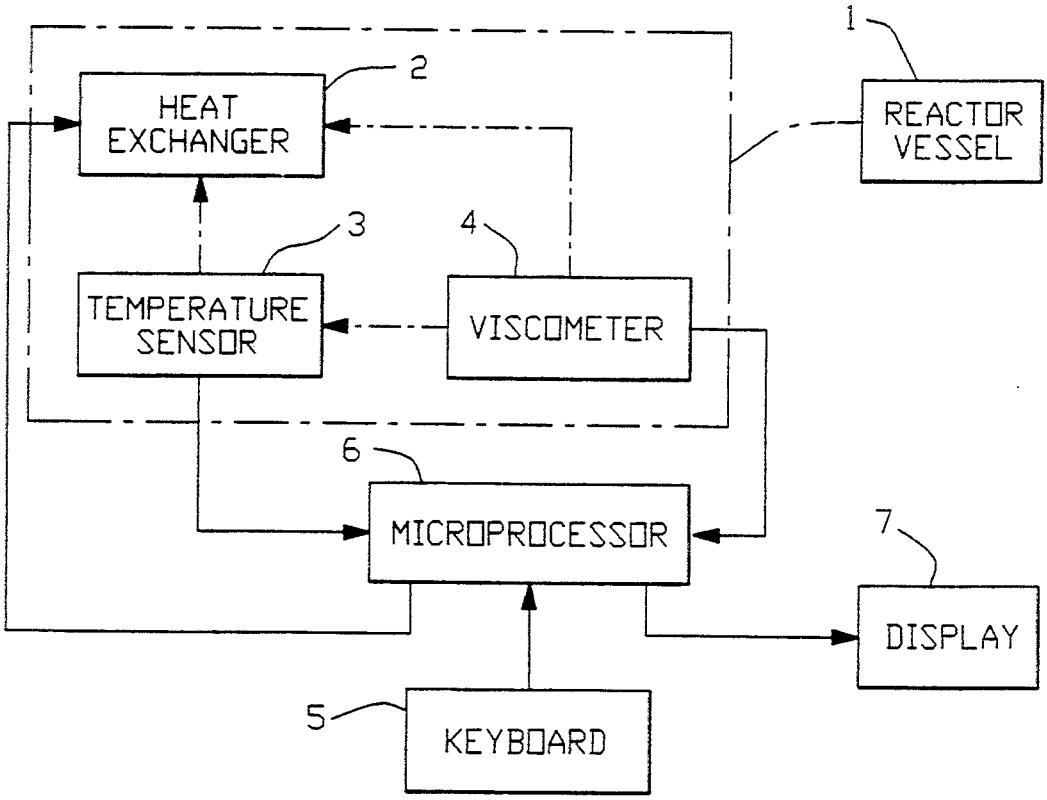
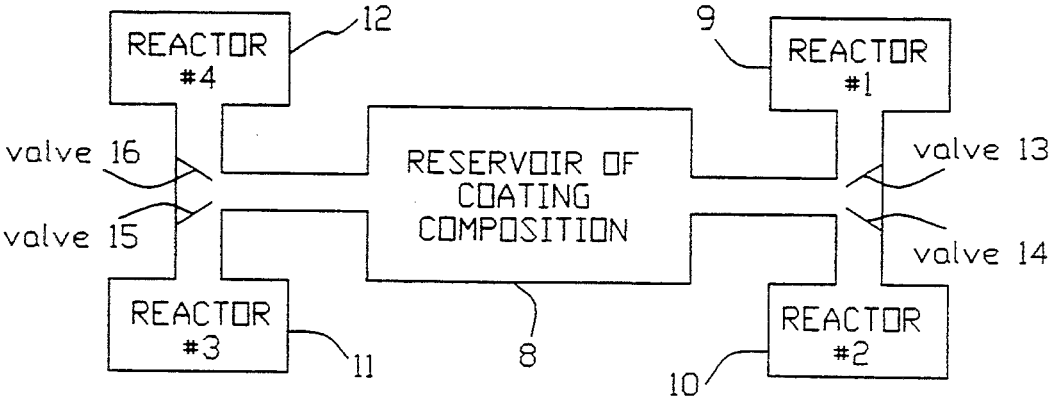
FIG. 2

METHOD OF COATING A SURFACE

FIELD OF THE INVENTION

The present invention relates to a novel method for the deposition of aqueous coating compositions in printing processes including wet-trap, gravure, offset (waterless or using water), silk-screen, flexography, off-line dry-trap, and related printing processes. In addition, the present invention relates to a method for depositing barrier coatings on paperboard trays and related items for use in the food industry. These barrier coatings are particularly useful for influencing the moisture vapor transition rate (MVTR) and oil and water resistance in paperboard packing to be used to store moisture sensitive foods.

Use of the present invention allows the adaptation of an aqueous coating to virtually any printing method without changing the chemical content of that formulation. The present invention, in certain embodiments, utilizes exceptionally high levels of solids in printing coating compositions and unexpectedly obtains acceptable viscosity, flow characteristics and mechanical transfer for these compositions. In addition, the present invention is readily adaptable to virtually every type of coating process used to coat inked, uninked and related surfaces. The method according to the present invention may also be adapted for use in the food industry to deposit barrier coatings on paperboard for food storage in order to influence the MVTR and oil and water resistance of the underlying packing or storage material.

BACKGROUND OF THE INVENTION

Aqueous coating compositions of a resinous thermoplastic coating material (clearcoat) such as thermoplastic, (meth)acrylic or (meth)acrylic-styrene copolymer in the form of emulsions are well known in the printing industry and presently are being used to coat inked and uninked layers during wet-trap, off-line dry-trap, gravure, offset, silk-screen, flexography and related printing or coating processes using an aqueous coating composition.

In one aspect of the above-referenced printing processes, an ink layer is first put down on a substrate in the form of paper, cloth, fiberboard, corrugated box, etc. and depending upon the process, the ink layer is first allowed to dry before it is coated, or is coated wet. In other methods according to the present invention, the coating may simply be placed onto an uninked or ink-free substrate. The aqueous coating serves to provide certain film characteristics including gloss, mar resistance, oil and water resistance, MVTR, and protection of the inked, uninked or related surface, adhesion and other characteristics. These film characteristics are generally determined by the weight of the coating applied and the amount or percent of solids used in the coating composition.

The prior art materials used as coatings in combination with the current print coating techniques are grossly limited in the solid contents that may be uniformly deposited onto a substrate from a coating composition and the degree of gloss value that a coating may obtain. In addition, as presently employed, the formulation of one aqueous coating may only be used in one or perhaps two processes; it is virtually impossible using the present methods without the present invention to provide one formulation which may be readily adapted for use in wet-trap, off-line dry-trap, gravure, offset, silk-screen, flexography and other printing processes.

In wet-trap in-line printing processes an ink coating (usually a hydrophobic ink) is first deposited onto paper, fiberboard, cardboard, corrugated paper or similar material, as a wet ink and then an aqueous coating is deposited onto the wet ink layer such that the ink is "trapped" under the aqueous coating to provide adequate film characteristics. In dry-trap off-line printing processes the ink is first dried before an aqueous coating is deposited onto the ink layer.

Gravure and flexography printing processes employ plates or etched cylinders (generally containing inverted pyramids) to deposit the ink layer (usually a water-based or solvent-based ink) which is generally dried before being coated by an aqueous coating. The result is a smooth finish without screen or dot pattern. In these applications, it is critical to have adequate mechanical transfer and flow characteristics to obtain adequate surface tension and favorable film characteristics after deposition.

In offset printing processes, the image to be reproduced is copied photographically upon a metal plate with a solution containing water to prevent the ink from adhering to the non-image area. When placed upon the appropriate cylinder of an offset press, the metal plate is inked in the image area only and makes an imprint of the image on a rubber-covered cylinder, which in turn, prints upon sheets of paper which are automatically fed into the machine. After the image has been deposited onto the paper, it may be coated using an aqueous coating in order to enhance the physical characteristics of the ink surface. Newer techniques in offet utilize waterless plates which keep the ink from adhering to the non-image area without the use of water, alcohol or fountain solution.

Silk-screen is a process employing a stencil to print a flat color design through a piece of silk or other fine cloth on which all parts of the design not to be printed have been stamped out by an impermeable substance.

The viscosity and consequently, the flow characteristics and mechanical transfer of an aqueous coating composition as used in printing processes, are directly influenced by the chemistry of the formulation, in particular, the percentage of solids that are present in the composition. In general, as the amount of solids in an aqueous coating composition increases, the mechanical transfer of the coating generally suffers, because the coating composition becomes too viscous to be efficiently deposited using the techniques presently available in the art. Often, the viscosity of an aqueous composition is the limiting factor in determining the transfer and the degree of usefulness of the coating composition. In general, upon application of an aqueous coating composition onto an inked, uninked or related layer, acceptable mechanical transfer will provide for a coating evidencing acceptable flexibility, durability, film-thickness and gloss, among other favorable film characteristics. In compositions which are too viscous, i.e., have poor flow characteristics and thus evidence inadequate mechanical transfer, the tendency is to produce a coating which evidences a "ribbing" or an uneven deposition of the coating. Inconsistency generally results from a coating having high viscosity.

The standard measure of aqueous coating viscosity in the printing industry is generally determined using a Zahn cup or equivalent. Zahn cups are identified with numbers representing the size of flow holes in cups. For example, the #2 cup is designed with a smaller hole than the #3 cup. To determine viscosity, a cup is chosen and then dipped into the aqueous coating composition until it is filled to the top. The composition will exit the cup from the hole depending upon the size of the hole and the viscosity of the composition measured. The composition stream leaving the cup is then timed with a stopwatch until the cup empties. The time that the composition takes to completely exit the Zahn cup hole in seconds represents the composition's viscosity. The viscosities of compositions may be compared directly based upon the equipment and the mechanical application used. Often the selection of a type of Zahn cup design used is based on the type of printing method utilized.

It is commonly known in the trade, for example, that the viscosity values (measured using a Zahn Drip Cup or equivalent measuring device) necessary for effective mechanical transfer for all printing methods will vary, based upon the mechanics of that printing process. For example, in the case of gravure printing processes, the viscosity for an aqueous coating useful in this process ranges from about 17 to about 28 seconds measured with a #2 Drip Cup. Silk screen printing requires a viscosity range of about 12 to about 23 seconds (#2 Drip Cup). In the case of flexography printing, the viscosity of the aqueous coating ranges from about 20 to about 60 seconds (#2 Drip Cup). In the case of offset printing, the viscosity of the aqueous coating ranges from about 15 to 30 seconds (#3 Drip Cup). One of ordinary skill will understand these values to represent exemplary useful ranges for practicing the present invention. The actual ranges may vary depending on the equipment and application used.

Under the present practice in the industry, the method employed for changing the viscosity of an aqueous coating formulation once it reaches the printing plant is to change the chemistry of the formulation, i.e., adjust the viscosity of the formulation by adding resinous material to increase viscosity or alternatively, by adding solvent to decrease viscosity. This is a time consuming and inefficient practice, especially where there is a need to use an aqueous coating in more than one type of printing process. To avoid this problem, there presently is a need to have several formulations of aqueous coating on hand, in order to accommodate the varying mechanical transfer requirements of the various printing processes. One aqueous coating formulation will simply not suffice.

In the present practice, the transfer of the aqueous coating composition is limited by the viscosity, which is affected by the amount of solids contained in the composition. As one increases the amount of solids, the viscosity of the aqueous coating also increases. It is generally recognized that as the amount of resin in the aqueous coating increases, the gloss, durability, film-thickness and related coating characteristics may tend to increase. Present coatings, however, are limited in the amount of solids that can be used without so dramatically increasing the viscosity of the coating formulations that they cannot be used in traditional printing processes. The present invention seeks to address this limitation to produce coatings having extremely high gloss, durability and film-thicknesses heretofore unknown in the printing industry using coating compositions which can be easily adapted for use in virtually all printing processes.

One of the major problems facing the printing industry is the need for using large amounts of volatile organic compounds or VOC's in aqueous coating compositions. Although a major component of an aqueous coating composition is water, in a majority of cases, in order to produce compositions containing high solid content, VOC's are added to the aqueous composition to lower the viscosity of high solids content compositions. At present, it is often not feasible to produce high solids content aqueous compositions without adding substantial quantities (greater than about 5% by weight) of at least one VOC, such as ethanol, isopropanol, a ketone, ether or the like. The addition of the VOC in present aqueous compositions is known to compatibilize the solids in the composition, thus producing a less viscous product than is produced without the VOC. Even with the VOC, however, the amount of solids that may be added to a composition is quite limited; the result is an aqueous coating composition which cannot produce the extremely favorable coating characteristics (especially high gloss values in combination with mar resistance, durability and flexibility) which are desired in today's market and which are produced using the method of the present invention.

The present invention may be adapted to provide extremely favorable coating characteristics, including high gloss value, increased film integrity and enhanced mar resistance without having to resort to the inclusion of substantial quantities of VOC's (which is the present practice). Thus, it is finally possible to formulate a single coating composition which will exhibit favorable mechanical transfer during coating and favorable film characteristics after deposition. This is an unexpected result. Thus, by utilizing the present invention, a single aqueous composition containing low VOC's or even an absence of VOC's can be generally adapted to a number of printing methods to provide exceptionally favorable coating and mechanical transfer.

In the food industry, paperboard having a moisture barrier coating has recently been used to replace polyboard (for use as food trays and related plastic food packaging material) for providing MVTR and oil and water resistance in storing food. In its present form, a moisture barrier coating (in preferred embodiments also incorporating oil and water resistance) is coated onto the surface of the paperboard so as to ultimately create a surface which can influence the moisture vapor transition rate and lower it to a level which is compatible with the storage of food, especially meat, poultry and other perishable items. Presently however, in order to create a coating thick enough or dense enough to materially impact the moisture vapor transition rate, an aqueous coating solution must be applied at least two or three times on a paperboard surface and subsequently dried. This has created great inefficiency in producing food packaging material and a clear need in the art exists for a process which can produce an adequate barrier coating on paperboard in only one coat. The method according to the present invention may be used to provide a barrier coating on paperboard in only one application, unlike the prior art methods.

OBJECTS OF THE INVENTION

It is an object of the present invention to provide a method for depositing an aqueous coating composition onto an ink or uninked surface in numerous printing processes including wet-trap, off-line dry-trap, gravure, offset, silk-screen, flexography and related printing processes without having to alter the chemistry of the aqueous coating compositions used in that printing process.

It is an additional object of the present invention to provide a method for depositing an aqueous coating composition onto a wet or dry ink surface in numerous printing processes without having to alter the chemistry of the aqueous coating composition.

It is still a further object of the present invention to provide a method for depositing a high solids content aqueous coating composition exhibiting favorable mechanical transfer onto an inked or uninked layer in numerous printing processes.

It is yet another object of the present invention to provide a method for depositing an aqueous composition containing no more than about 5% by weight VOC's onto an ink layer in numerous printing processes.

It is still another object of the present invention to provide a method for depositing an aqueous composition containing an absence of VOC's onto an ink layer in numerous printing processes.

It is yet still an additional object according to the present invention to provide a barrier coating on paperboard to be used in the food industry in one application, by depositing an aqueous coating composition on the paperboard and allowing the coating composition to dry.

Still an additional object of the present invention resides in the ability to provide coatings on a number of surfaces which vary greatly in componentry and coating characteristics.

These and other objects of the present invention may be readily gleaned from the description of the present invention which follows.

BRIEF DESCRIPTION OF THE INVENTION

The present invention relates to a method for depositing an aqueous coating composition in the form of a solution, dispersion or emulsion onto an inked or uninked layer in a printing process such as wet-trap, off-line dry-trap, gravure, offset (water or waterless), silk-screen, flexography and other printing processes such that a single aqueous coating composition may be adapted easily for use in a number of printing processes under typical or standard printing conditions without the need for chemical modification of the aqueous coating composition used in that printing process. Thus, according to the present invention, a single aqueous coating composition may be adapted for use in printing processes requiring vastly different viscosities.

In accordance with one aspect of the present invention, the method is directed to coating a substrate (inked or uninked) and comprises the steps of:

1). Depositing a first layer of ink onto a surface to be coated;

2). Drying said ink layer;

3). Determining a desired viscosity of an aqueous coating composition to be deposited onto said ink layer and/or said uninked surface;

4). Determining the temperature other than at ambient temperature at which said composition attains the viscosity determined in step 3);

5). Maintaining the viscosity of said composition at the temperature determined in step 4); and 6). Depositing onto said ink layer and/or said surface said aqueous coating composition at said set temperature.

The present method also relates to a wet-on-wet printing process for coating an inked and/or uninked surface. This method comprises the steps of:

1). Depositing a first layer of hydrophobic ink onto a surface to be coated;

2). Determining a desired viscosity of an aqueous coating composition to be deposited onto said ink layer and/or said uninked surface;

3). Determining the temperature other than at ambient temperature at which said composition attains the viscosity determined in step 2);

4). Maintaining the viscosity of said composition at said temperature determined in step 3); and 5). Before said ink layer is dry, depositing onto said ink layer and/or said surface said aqueous coating composition at said set temperature.

The present invention also relates to a process for enhancing the solids content of a coating to instill favorable film characteristics, including high gloss, film integrity and mar resistance without causing undesirable flow characteristics and mechanical transfer. This method allows for the incorporation of unexpectedly high levels of solids in coating compositions used to coat inked and/or uninked surfaces in printing processes. In this aspect the present method comprises the steps of:

1). Preparing a high solids content aqueous coating composition for coating an inked and/or uninked surface in a printing process, said composition having a viscosity above a range useful in said process at ambient temperature, said composition comprising:

a. preferably at least about 10% and most preferably at least about 20% by weight of a low molecular weight film-forming polymer or resin;

b. preferably at least about 10% and most preferably at least about 20% by weight of a high molecular weight film-forming polymer or resin;

c. an amount of a wetting agent effective to eliminate leveling problems caused by surface tension; and d. the remainder of the composition comprising an aqueous solvent or mixture of solvents;

2). Depositing a first layer of ink onto a surface to be coated;

3). Determining a desired viscosity of said aqueous coating composition to be deposited onto said ink layer and/or said uninked surface;

4). Determining a temperature above ambient temperature at which said composition attains the viscosity determined in step 3);

5). Maintaining the viscosity of said composition at said temperature determined in step 4) to allow deposition of said composition; and 6). Depositing onto said ink layer or uninked surface said aqueous coating composition at said set temperature.

The present invention also relates to a process for coating an inked and/or uninked surface using an aqueous coating composition containing less than about 5% by weight VOC's, preferably an absence of VOC's. In accordance with this aspect, the present method comprises the steps of:

1). Preparing an aqueous coating composition for coating an ink layer and/or uninked surface containing no more than about 5% by weight VOC comprising:

a. preferably at least about 10%, and most preferably at least about 20% by weight of a low molecular weight film-forming polymer or resin;

b. preferably at least about 10% and most preferably at least about 20% by weight of a high molecular weight film-forming polymer or resin;

c. an amount of a wetting agent effective to eliminate leveling problems caused by surface tension; and d. the remainder of the composition comprising a mixture of water and optionally, at least one solvent in the form of a volatile organic compound (VOC), the amount of said solvent comprising no greater than about 5% by weight of said aqueous coating composition;

2). Depositing a first layer of ink onto a surface to be coated; and

3). Determining a desired viscosity of said aqueous coating composition to be deposited onto said ink layer and/or said uninked surface;

4). Determining a temperature at which said composition attains the viscosity determined in step 3);

5). Maintaining the viscosity of said composition at said temperature determined in step 4); and 6). Depositing onto said ink layer and/or said uninked surface said aqueous coating composition at said set temperature.

The present invention also relates to a method for providing a moisture proof barrier coating evidencing MVTR and oil and water resistance on a substrate, preferably paperboard, for use in the food industry comprising:

1). Preparing a high solids content aqueous coating composition for deposition onto a substrate, said composition containing an amount of a film-forming polymer effective to produce a moisture-proof barrier coating on said substrate after only one application;

2). Determining a desired viscosity of said aqueous coating composition to be deposited onto said substrate;

3). Determining the temperature above ambient temperature at which said composition attains the viscosity determined in step 2);

4). Maintaining the viscosity of said composition at the temperature determined in step 3); and 5). Depositing onto said substrate said aqueous coating composition at said set temperature.

The various methods according to the present invention may be readily adapted to utilize numerous aqueous compositions containing optional components including mar or scuff resistant agents, hardening agents, coalescing agents, plasticizing agents and defoaming agents, among others, which are added in effective amounts to provide the desired results.

BRIEF DESCRIPTION OF THE FIGURES

FIG. 1 provides a pictorial representation of a temperature control vessel or reactor which can be used in the method according to the present invention.

FIG. 2 provides a pictorial representation of a system for employing a single coating composition in a number of different printing processes, the coating for each of the processes being adapted by adjusting viscosity in each of the four reactors.

DETAILED DESCRIPTION OF THE INVENTION

The term "transfer" or "mechanical transfer" is used throughout the specification to describe the ability of an aqueous coating composition to be deposited onto a surface in a printing process. Ease, efficiency and consistency of deposition are influenced by the viscosity and the flow characteristics of aqueous coating compositions used in the present invention. Viscosity is a physical characteristic of aqueous coating compositions which dramatically influences the flow characteristics of the compositions and consequently, mechanical transfer of those compositions in printing processes. As a general rule, by varying the viscosity of a coating composition, one can dramatically influence the flow characteristics and consequently, the mechanical transfer of compositions onto inked and uninked substrates pursuant to the present invention.

The term "(meth) acrylate or (meth) acrylic" is used throughout the specification to describe a monomer, polymer or copolymer which is or is derived from acrylic acid, methacrylic acid, esters of these acids or mixtures thereof.

The term "aqueous coating composition" is used throughout the specification to describe an aqueous composition in the form of a solution, emulsion or dispersion which is capable of being deposited onto and coating an ink layer in a printing process according to the present invention. As used in the present invention, an aqueous coating composition contains effective amounts of a low molecular weight film-forming polymer, a high molecular weight film-forming polymer, a surfactant or emulsifier and an aqueous solvent, usually a mixture of water and at least one additional solvent, generally a volatile organic compound (VOC), and optionally other components which may affect or improve coating characteristics. In particularly preferred embodiments according to the present invention, aqueous coating compositions contain an absence of VOC's.

The term "volatile organic compound" or "VOC" is used throughout the specification to describe most volatile solvents other than water which are used in the aqueous coating compositions according to the present invention. VOC's include, for example, methanol, ethanol, isopropanol, acetone, methylethylketone, various esters including methyl acetate, ethyl acetate, propyl acetate, among others, including chlorinated hydrocarbons, various ethers and alkanes, among others. In preferred embodiments according to the present invention, aqueous coating compositions according to the present invention contain no greater than about 5% by weight of a VOC and most preferably, an absence of VOC's.

The term "coating" is used to describe the film that remains on the ink, uninked or related surface after deposition and drying of the aqueous coating composition. Coatings which are conventionally used in the coatings industry include for example, Blister Card Coatings, characterized primarily by excellent adhesion, heat reaction and fiber tear; MAT Coatings, a low gloss coating characterized by a low gloss value of about 10° to about 30°; Semi-gloss coatings (relatively low gloss value) characterized by low gloss value of about 30°–40°; Barrier Coatings, characterized by MVTR and water and oil resistance; Heat Resistant Coatings; Anti-Porosity Coatings; Mold Resistant Coatings; Heat Resistant Barrier Coatings, characterized by MVTR, water, oil and heat resistance; Overprint Coatings, characterized by high gloss, mar resistance, exceptional durability and adhesion and protection of the underlying substrate; Prime Coatings, characterized by their primer characteristics including good holdout and minimal absorption; and Alkaline Resistant Coatings, among others. The film characteristics of the coatings related to the present invention are determined primarily by the componentry and amount (or percent) of solids and other additives used in the aqueous coating composition.

The terms "film-forming polymer" and "film-forming resin" or "resin" are used synonymously throughout the specification to describe the low or high molecular weight polymers or resins which are added to the aqueous coating compositions according to the present invention to instill favorable film characteristics to the dried coating. Film-forming polymers for use in the present invention include thermoset resins, thermoplastics, UV-cured film-forming polymers and mixtures of these film-forming polymers or resins.

The present invention relates to methods for depositing aqueous coatings onto an ink layer to provide adequate film characteristics such as mar or scuff resistance, durability, rub resistance and gloss.

In one aspect of the present method, an aqueous coating in the form of a solution, dispersion or emulsion is deposited onto a dry or wet ink layer. When the ink to be coated is dried before the aqueous coating composition is deposited, the ink may be any chemical composition typically used in printing, but is preferably insoluble in a hydrophilic (aqueous) solvent and in particular, the polar aqueous solvent or solvent mixtures used in the aqueous coating compositions according to the present invention. Thus, the ink coating may be comprised of hydrophilic or hydrophobic inks as typically used in the printing industry, with the proviso that the dried ink preferably should not be miscible with or soluble in the coating composition used to coat the ink layer. Otherwise, the coating may produce smudging or smearing of the ink layer during deposition as the coating and ink layer interact, a condition to be avoided if possible. Depending upon the printing process, it may be preferred to use hydrophobic inks (wax-free or containing wax) or hydrophilic inks to impart favorable characteristics to the final coated substrate.

In instances where the printing process employs a wet-on-wet process, for example, a wet trap in-line process, the ink used is wet (i.e., still contains significant amounts of solvent) during the deposition of the aqueous coating. In this process, it may be preferred to utilize a hydrophobic ink. After deposition of the ink layer, the aqueous coating, preferably in the form of a porous coating, can be deposited onto the ink layer. The use of a hydrophobic ink will generally minimize the tendency of the ink to smudge while both layers are still wet, at least in part.

In the present invention, depending upon the printing process utilized, the amount of ink deposited as the first layer and the amount of aqueous coating composition deposited as the second layer will vary over a wide range, and consequently the viscosity, flow characteristics and mechanical transfer of the aqueous coating composition will also vary over a rather wide range.

In the present method, the aqueous coating composition may be deposited by any process, including rolling the composition onto the substrate. By using the present invention, viscosity is virtually eliminated as a critical characteristic.

The aqueous coating composition used in the present method employs at least three, and preferably four components:

1) a low molecular weight film-forming polymer or resin solid in an amount effective to provide adequate gloss to the dried coating;

2). a high molecular weight film-forming polymer or resin solid in an amount effective to support the low molecular weight film-forming polymer and preferably, provide adequate film characteristics including mar or scuff resistance, rub resistance, durability and film integrity to the dried coating alone or in combination with optional additives;

3) an amount of at least one wetting agent or surfactant effective to eliminate leveling problems caused by surface tension of the coating during deposition onto the ink layer; and 4) the remainder of the composition a polar solvent, preferably an aqueous solvent containing less than about 5% of at least one VOC and most preferably containing an absence of VOC's.

In general, the amount of film-forming polymer solid (1 and 2, above) used in the aqueous coating composition ranges from about 15% to about 85% by weight of the composition, with a preferred range of at least about 40% within this range. In general, the more film-forming polymer solid used in the aqueous coating composition, the greater will be the viscosity of the coating composition and the more favorable will be the dry film characteristics of the final coating.

A low molecular weight film-forming polymer or resin is added in an amount effective to instill resolubility, press performance and wetting characteristics to the coating composition before and during deposition and to instill adequate gloss to the dried coating composition (depending upon the type of coating produced, e.g., MAT coatings, Semi-Gloss, etc., the final product will read at least about 10° reflection on a Mallincrodt 60° pocket glossmeter, preferably at least about 40° reflection for high gloss). Generally, the amount of low molecular weight film-forming polymer will range from about 0% to about 99.995% by weight of the combined weight of low and high molecular weight film-forming polymers used in the aqueous compositions and preferably about 10% to about 90% by weight of the combined weight of film-forming polymers.

While not being limited by way of theory, it is believed that the low molecular weight film-forming polymer instills gloss to the dried coatings by virtue of its ability to reflect light from the surface of the coating. Because of its relatively small size, the low molecular weight film-forming polymer has a tendency to "lay flat" on the surface of the coating. Such an orientation is believed to enhance the ability of the polymer to reflect light, resulting in a higher gloss value. High molecular weight film-forming polymer, because of its relatively large size, has a tendency not to "lay flat" on a surface, thus enhancing the ability of the polymer to absorb light. Consequently, high molecular weight film-forming polymer instills little, if any, gloss to the coating composition, but instead provides durability and integrity characteristics to the coating as well as support for the low molecular weight film-forming polymer.

It is thus the combination of low and high molecular weight film-forming polymers which provides many of the favorable film characteristics. One of ordinary skill in the art will recognize to adjust the relative weight ratio of low and high molecular weight film-forming polymers in order to instill favorable film characteristics to the dried coating compositions.

A high molecular weight film-forming polymer or resin is added to the aqueous coating composition in an amount effective to support the low molecular weight film-forming polymer and instill mar resistance, rub resistance, durability and integrity to the dried coating composition alone or in combination with optional components such as mar resistance agents and/or hardening agents, among others in a particular coating application. Generally, the amount of high molecular weight film-forming polymer or resin will range from about 0% to about 99.995% by weight of the combined weight of low and high molecular weight film-forming polymers used in the aqueous compositions and preferably about 10% to about 90% by weight of the combined weight of film-forming polymers.

In the aqueous composition according to the present invention, the combined weight of solids (which includes low and high molecular weight film-forming polymers, a surfactant, and optionally, other additives) preferably should comprise no more than about 85% of the total weight of the composition and the aqueous solvent should generally comprise no less than about 15% by weight of the composition, and preferably at least about 30% by weight of the composition. Generally, when the amount of solids is above about 85% by weight of the composition, the composition may become too viscous to have adequate transfer. An amount of solids below about 15% is often insufficient to instill adequate film characteristics in the dried coating. Solids include the low and high molecular weight film-forming polymers, wetting agent or surfactant, mar (scuff) resistant agent, hardening agent, coalescing agent, plasticizing agent and defoaming agent, among other components which are not otherwise considered solvents.

The effective amount of wetting agent or emulsifier used in the present invention will generally range from about 0.005% to about 20% or more by weight of the aqueous coating composition. This amount is generally effective to provide sufficient wetting of the coating to eliminate leveling problems which may be caused by surface tension during deposition onto the inked or uninked layer. The amount and type of wetting agent or surfactant used will generally depend upon the wetting characteristics of the solids without the wetting agent. It is noted that the film-forming polymers and preferably, the low molecular weight film-forming polymer, also may be adapted to instill wetting characteristics to the coating composition. One of ordinary skill in the art will recognize to vary the amount and type of wetting agent and the amount of type of film-forming polymer within the teachings of the present invention to provide adequate wettability and to eliminate surface tension in coating compositions according to the present invention.

In addition to the above-three components, the aqueous coating composition optionally comprises additional components which may improve mechanical transfer and/or film characteristics of the dried film, especially strength, gloss and durability, among others. Thus, aqueous coating compositions according to the present invention may employ any one or more of the following components: a mar (scuff) resistant agent, a hardening agent, a coalescing agent, a plasticizing agent and a defoaming agent, among others.

In the present invention any film-forming polymer typically used in coatings in the printing industry may be used. As used herein, the term "film-forming polymer" is used to describe those high and low molecular weight polymers or resins which can be formulated in aqueous coating compositions according to the present invention. These polymers can include thermoplastic resins, UV cured and related coating resins which form a major component of the aqueous coating composition used in the present invention. The term film-forming polymer can include oligomeric resins which have the ability to be UV or heat polymerized or cross-linked. In the case of UV or heat polymerized coatings, the film-forming polymer may be formulated alone or in combination with UVor heat polymerizable monomers.

It is noted that the term "film-forming polymer" embraces a large number of polymers and related resins used in the aqueous coating compositions according to the present invention and is not simply limited to the thermoplastic resins. Thus, film-forming polymers may include UV cured film-forming polymers as well as, in certain cases, thermoset resins, among others. Various mixtures of film-forming polymers may also be used.

The film-forming polymer may be any resinous or polymeric material including for example, poly(vinyl alcohol) and related copolymers, poly(methyl methacrylate) and related (meth)acrylate and acrylate copolymers, polystyrene and related copolymers, polyester copolymers, nylons, polyamides, polyethylene glycols, polyimides, polycarbonates, epoxies, polyacrylonitriles, polyethylene, polyvinyl, and polyvinylpyrrolidones, among others, including numerous copolymers of mixtures of monomers used in the above-described resinous materials. Preferably, the film-forming polymer is a relatively hydrophilic or water-dispersible resin or polymer.

Preferred film-forming polymers for use in the present invention include various water soluble or water dispersible copolymers of the following monomers: styrene, alpha-methylstyrene, ar-ethylstyrene, vinyltoluene, a,ar-dimethylstyrene, ar-t-butylstyrene, o-chlorostyrene, m-chlorostyrene, p-bromostyrene, 2,4-dichlorostyrene, 2,5-dichlorostyrene, among other styrene-containing polymers, vinylnapthalene, alkylesters of (meth)acrylic acid such as n-hexyl (meth)acrylate, ethylbutyl (meth)acrylate, 2-ethyl-hexyl (meth)acrylate, n-octyl (meth)acrylate, ethyl (meth)acrylate, methyl (meth)acrylate, n-decyl (meth)acrylate, dodecyl (meth)acrylate and similar (meth)acrylic acid esters, alpha,beta-ethylenically unsaturated carboxylic acids, for example acrylic and methacrylic acid, fumaric acid, itaconic acid and mixtures of these acids, among others. Highly preferred film-forming polymers for use in the present invention include styrene(meth)acrylate copolymers and derivatives thereof. Acidic monomers are preferably included in film-forming polymers to instill wettability characteristics to the polymer (by forming the free carboxylate which is water soluble).

While the above-described film-forming polymers are preferred for use in the present invention, it is clearly understood that one of ordinary skill in the art will be able to adapt other standard and non-standard film-forming polymers available in the art to the present methods without engaging in undue experimentation.

Preferred low and high molecular weight film-forming polymers used in the present invention generally have acid numbers ranging from about 5 to about 800, a $T_g$ ranging from about −75° C. to about 150° C. and average molecular weight of about 100 to about 5,000,000 or more, generally about 100 to about 20,000, preferably about 500 to about 15,000 for low molecular weight film-forming polymers and generally from about 30,000 to about 5,000,000 or higher, preferably about 100,000 to about 2,000,000 for high molecular weight film-forming polymers. The film-forming polymers used in the present invention evidence good porosity, and depending upon application, may have particle sizes consistent with this porosity of about 1 nanometer to about 20 microns. In addition to the above characteristics, the film-forming polymers used in the present invention preferably evidence good flexibility within the range (both direct impact and reverse impact) of about 5" per 1 lb. to about 160" per 1 lb.

The low and high molecular weight film-forming polymers used in the present invention are most preferably acrylic or acrylic-styrene copolymers.

Aqueous coating compositions according to the present invention preferably evidence acid numbers in the range of about 5 to about 800, a pH in the range of about 2 to 12 and a percentage of solids in the range of about 15% to about 85% by weight. In the aspect of the present invention utilizing high solids content aqueous coating compositions for high gloss, the total amount of low and high molecular weight film-forming polymer or resin solids ranges from about 42% to about 85%, preferably at least about 50%, by weight of the composition.

In the general aqueous coating compositions used in the present invention, the high and low molecular weight film-forming polymers preferably comprise about 15% to about 85% by weight, and most preferably about 42% to about 85% by weight, the remainder being made up of other components as more fully described hereinbelow.

In addition to low and high molecular weight film-forming polymers, the aqueous coating compositions contain an effective amount of a wetting agent or surfactant to compatibilize or emulsify the film-forming polymers in the aqueous solvent. As used herein, the terms "wetting agent" and "surfactant" describe compounds added to the film-forming polymers and solvent mixture to emulsify and compatibilize the film-forming polymer in the solvent. Wetting agents for use in the aqueous compositions used in the present invention include, for example, OT 75 from American Cyanamid, FC129 from 3M Co., Surfynol 104E by Air Products & Chemicals, Inc., among a huge number of others. In general, the amount of wetting agent or surfactant included in the aqueous coatings of the present invention is at least about 0.005%, preferably at least about 1% to about 20% and most preferably about 1.5% to about 10% by weight of the composition, which amounts are generally sufficient for virtually eliminating surface tension.

In addition to the low and high molecular weight film-forming polymers and wetting agent, the aqueous compositions include an effective amount of a solvent, generally ranging from about 15% to about 80–85% by weight of the composition. Solvents used to formulate the aqueous coating compositions according to the present invention include, for example, water and optionally, at least one additional solvent for example, ethanol, methanol, acetone, methylethyl ketone, ethyl acetate, methyl acetate, isopropanol, n-butanol, n-butyl acetate, methylchloroform, methylene chloride, toluene, xylene, other aromatic (containing phenyl groups) solvents and mixtures thereof, among others, amyl acetate, numerous ethers, numerous other ketones and alkanes including pentane, cyclopentane, hexane, and cyclohexane, cyclic ethers such as tetrahydrofuran and 1,4-dioxane, among other solvents, including cellosolve, butyl cellosolve acetate, cellosolve acetate, methyl cellosolve acetate, butyl cellosolve and ethyl cellosolve.

One important aspect of the present invention involves a method which can accommodate very high solids content in aqueous coatings without the need to adjust viscosity by adding relatively large quantities of a Volatile Organic Compound (VOC). In this method, water is most preferably the only solvent utilized in the coating composition. This will allow the method to be practiced in an environmentally compatible manner.

In addition to at least one low molecular weight film-forming polymer and one high molecular weight film-forming polymer, a solvent or mixture of solvents and a wetting agent or surfactant, the aqueous coating compositions according to the present invention also include at least one of the following: mar (scuff) resistant agents, hardening agents, coalescing agents, plasticizer agents and defoaming agents, among others, including agents to reduce the coefficient of friction and provide adequate slip and/or slide angle.

Exemplary mar resistant agents are added to the present invention in an amount effective to provide rub or mar resistance, and generally range from about 0.1% to about 20% by weight of the composition and include, for example, polyethylene and/or paraffin wax (available from S. C. Johnson & Son, Inc.) and Teflon SST-3 from Shamrock Chemicals, among others. Exemplary hardening agents are included in amounts generally ranging from about 0.1% to about 10% by weight and include, for example, zinc oxide (available in solution from S. C. Johnson & Son, Inc.), among others. Exemplary coalescing agents are included in amounts generally ranging from about 0.1% to about 10% by weight and include, for example butyl cellosolve from Union Carbide Corp. and propylene glycol from Olin Corp, among others. These agents serve to render flexibility to films in effective amounts. Exemplary plasticizing agents are generally included in amounts effective to produce adequate flexibility and adhesion to prevent chipping and cracking of the film, generally from about 0.1% to about 10% by weight of the composition. Plasticizing agents include, for example, Santicizer 160 and Santicizer 141 from Monsanto Corp., among numerous other plasticizing agents. Exemplary defoaming agents are included in amounts effective to substantially break up any foam that may occur during formulation or during the deposition process and generally about 0.1% to about 3% by weight of the aqueous composition. Defoaming agents include, for example, Foamkill 875 from Crucible Chemicals Corp. and Balab 3065A from Witco Corp., among others. Exemplary coefficient of friction agents are included in amounts effective to instill adequate slip or slide angle, i.e. generally about 0.1% to about 5% by weight. Exemplary coefficient of friction agents include LE 410 from Union Carbide Corp., among other agents.

All of the above-described agents are included in aqueous compositions according to the present invention in amounts effective to substantially instill the final coating with the characteristics sought in adding the component to the composition.

Preferred aqueous coating compositions according to the present invention include no more than about 5% by weight Volatile Organic Compounds (VOC's) and preferably contain an absence of VOC's.

In formulating the aqueous compositions according to the present invention, the film-forming polymers and surfactant are first formulated by mixing in an aqueous solvent. After sufficient mixing, the other additives may be added, also followed by mixing. Alternatively, one can add the film-forming polymers, surfactant and optional additives all at once to the aqueous solvent, followed by mixing. In certain instances, it may be advantageous to mix low or high molecular weight film-forming polymer separately with a solvent and optionally, surfactant, before adding the other film-forming polymer.

In accordance with the general method of the present invention, an apparatus as depicted in FIG. 1 is useful for carrying out the present invention. The apparatus includes a reactor vessel 1 into which is placed the aqueous coating compostion to be deposited onto an ink layer.

The reactor containing coating composition is provided with a heat exchanger 2 for heating or cooling the aqueous coating composition to a temperature above or below ambient temperature. The heat exchanger preferably takes the form of heating or cooling coils which are preferably connected to the inside of the reactor or within the reactor chamber. This will allow an efficient transfer of heat into or out of the chamber in order to raise or lower the temperature of the aqueous coating composition.

Reactor 1 may also contain a thermocouple 3 or other temperature sensor to measure the aqueous coating composition within the reactor. The thermocouple 3 may be operatively connected to the heat exchanger to regulate the exchanger to raise or lower the temperature of the aqueous coating composition in the reactor. Thermocouple 3 may be set to a specified temperature corresponding to a predetermined viscosity of the aqueous coating composition utilized. In this aspect of the invention, the thermocouple will regulate the temperature of the coating composition in order to maintain the predetermined viscosity of the composition.

Alternatively and preferably, thermocouple 3 is operatively connected to a viscometer 4 which measures and determines the viscosity of the aqueous coating composition. Depending upon the viscosity reading, viscometer 4 signals thermocouple 3 and/or heat exchanger 2 to vary the temperature of the aqueous coating composition above or below ambient temperature to initially obtain and thereafter maintain the desired viscosity.

In addition, viscometer 4 and/or thermocouple 3 may be operatively coupled to a keyboard or pad 5 for inputting predetermined viscosity and/or temperature values or ranges. Keyboard 5 is connected to a microprocessor 6 in order to facilitate the maintenance of viscosity of the aqueous coating. In response to input from thermocouple 3 and/or viscometer 4, and in accordance with instructions and range values input via keyboard 5, microprocessor 6 controls heat exchanger 2 to vary the temperature inside reactor 1. A display monitor 7 provides visual feedback of temperature, viscosity settings, etc. to an operator. Inputting viscosity measurements within a predetermined range for a coating application will enable an operator through microprocessor 6 and thermocouple 3 to control the temperature and, consequently, the viscosity of the aqueous coating composition. Viscometer 4 may serve as a gauge to constantly measure the viscosity of the aqueous coating to ensure that the aqueous coating always has the same viscosity as is desired for a particular application. Microprocessor 6 may be driven by simple software which can be stored in a read only memory (ROM), erasable, programmable read only memory (EPROM) or other standard memory devices with the proviso that the software may be easily modified to accommodate the temperature and/or viscosity measurements desired for the printing process to be employed. The software may allow for the input and/or storage of set ranges of viscosities and/or temperatures.

Alternatively, reactor 1 may simply be operatively connected to heat exchanger 2 to manually regulate temperature. Optionally, a thermocouple 3 may be operatively connected to heat exchange 2 to provide electronic regulation of the temperature of the aqueous coating in reactor 1.

For a particular coating process, for example, wet-trap in-line, off-line dry-trap, gravure, offset, silk-screen, flexography, the viscosities of a coating composition will fall within certain values. For example, in the case of gravure printing processes, the viscosity of an aqueous coating composition ranges from about 17 to about 28 seconds measured with a #2 Drip Cup. This translates to a viscosity measurement range of about 19 to about 60 centipoises. In the case of silk screen printing, this requires a viscosity range of about 12 to about 23 seconds (#2 Drip Cup) or a range of about 7 to about 40 centipoises. In the case of flexography printing, the viscosity of the aqueous coating ranges from about 20 to about 60 seconds (#2 Drip Cup), or about 30 to about 140 centipoises. In the case of offset printing, the viscosity of the aqueous coating ranges from about 15 to 30 seconds (#3 Drip Cup), or about 80 to about 225 centipoises.

Thus, the reactor according to the present invention may enable an operator to input a desired range or ranges of temperatures and/or viscosities which are determined for a particular application and to have that range or ranges of temperatures and/or viscosities maintained for a period sufficient to complete a printing operation. The result is consistency in depositing aqueous coating compositions regardless of the printing process or composition used.

FIG. 2 depicts the adaptability of the method of the present invention for use in a plurality of printing processes. In FIG. 2, reservoir 8 contains a single aqueous coating composition. Coating composition flows to reactors 9–12 through valves 13–16 which can be opened or closed. Each of the four reactors depicted is capable of maintaining the viscosity of the coating composition within a preset or predetermined range, as described above. Depending upon the printing method employed, the transfer of the aqueous composition may be modified simply by adjusting and maintaining the viscosity within a predetermined range. Each reactor may have a different viscosity depending upon the printing method employed. Thus, it is possible using the method of the present invention to accommodate a plurality of printing processes without the need to chemically adjust the aqueous coating composition. This is an unexpected result and a clear advance in the printing art.

The following examples are provided to illustrate the present invention and should not be construed to limit the scope of the invention of the present application in any way.

EXAMPLE 1

Experiment to determine the effect temperature has on the viscosity of an aqueous coating composition and thus the feasability of using that composition in a a number of applications, an aqueous coating composition according to the present invention was formulated from a (meth)acrylic/styrene copolymer. This composition was thereafter exposed to varying temperatures to establish a correlation between viscosity and temperature.

(1) Preparation of the Aqueous Coating Compostion

An aqueous coating composition according to the present invention was prepared for use in three known printing processes. It contained the following components in the indicated formula.

| | |
|---|---|
| Water | 81 grams |
| Wetting Agent (Aerosol OT 75 by American Cyanamid) | 9 grams |
| High Molecular Weight Polymer (Styrenated Acrylic Polymer Emulsion-Joncryl 89 from Johnson Wax) | 105 grams* 48% solid |
| Low Molecular Weight Polymer Emulsion (Solid Acrylic Resin 98% non-volatile-Joncryl 682 from Johnson Wax) | 105 grams* 60% solid |

*Note that the high molecular weight polymer emulsion contains 50 grams of solid and the low molecular weight polymer emulsion contains 63 grams of solid, the remainder being aqueous solvent.

The above coating composition was prepared by agitating a mixture of the above components in an electronic blender and agitating until thoroughly mixed.

This composition was sufficiently dispersed by homogenizing in a homogenizing mixture for 5 minutes at which time the temperature of the composition was taken using a TEL TRU thermometer. The temperature was 82° F. The viscosity of the composition was measured by use of a #3 and a #2 Zahn drip cup and an Aristo Apollo stopwatch. The viscosity of the composition at 82° F. was 17 seconds with a #3 cup and 43 seconds with a #2 cup.

(2) Viscosity Relationship

To determine the relationship between viscosity and temperature for the above-described composition, the temperature of the composition was varied and the viscosity of the composition measured at each temperature interval. The results of this experiment appear in Table 1, below.

| Temperature (°F.) | Viscosity (#3 Cup) | Viscosity (#2 Cup) |
|---|---|---|
| 117° | 11 Sec. | 26 Sec. |
| 110° | 11.5 Sec. | 27 Sec. |
| 104° | 12 Sec. | 29 Sec. |
| 72° | 20 Sec. | 53 Sec. |
| 70° | 21 Sec. | 59 Sec. |
| 64° | 26 Sec. | 71 Sec. |
| 58° | 31 Sec. | 82 Sec. |
| 50° | 38 Sec. | 101 Sec. |
| 42° | 47 Sec. | 123 Sec. |

This experiment evidences that the increase or decrease of temperature dramatically affects the viscosity of the aqueous coating composition utilized. We note that within the range of 42° and 117° F. the viscosity values which were realized using the instant composition are consistent with the use of this composition in offset (64° F.–72° F.), gravure (110° F.–117° F.) or flexography (70° F.–117° F.) printing processes.

(3) Gloss Reflection Value (Gloss Value) & Solid Composition

In order to determine the gloss reflection value of the coating composition a uniform coating weight using a Pamarco Inc. hand proofer was put on a substrate (Westvaco low density SBS with 18 point calibration) and measured with a Mallinckodt 60 pocket gloss reader. The gloss value obtained will vary depending on the absorption rate of the surface being coated. A high reading of 71.3 gloss reflection value was obtained. The percentage of solids in the composition was determined with use of a Ohaus moisture balance scale which weighs the solids after drying out the liquids. This coating composition was 40 ±2% solid. The gloss reflection value for this composition is commercially viable for all of the different types of printing processes.

(4) Conclusion

The viscosity of the coating composition was altered by the change in temperature. A decrease in the temperature resulted in higher viscosity levels and an increase in the temperature resulted in lower viscosity levels. While not being limited by way of theory, it is believed that at low temperatures, the segmental motion in the polymer chain is slowed and/or frozen (depending on the temperature employed), thus increasing the viscosity. Conversely, when the polymer is heated, the polymer chain undergoes an energizing segmental rotation resulting in decreased viscosity. Quite unexpectedly, this turns out to be true regardless of the additional components one adds to the coating composition.

The results of this experiment evidence the adaptability of the present method in virtually any printing application including offset printing (using for example, a Mann-Roland Rekord MultiColor Press with a two roll in-line dedicated tower coater), gravure (using for example, a high speed Goss Rotogravure, multi-unit printing press with engraved gravure cylinder), and flexography (using for example, a Manhasset flexography printing press with a flexographic 2-roll transfer system)—even though each process has significantly different viscosity requirements and the present art cannot accommodate the same formulation as easily and efficiently as the present invention. Inasmuch as the useful offset range is 15 to 30 seconds with a #3 cup; the useful gravure range is 17 to 28 seconds with a #2 cup, and the useful flexography range is 20 to 60 seconds with a #2 cup, the present method can accommodate each of these printing processes to produce commercially viable results. We note that the viscosity of the composition at the starting temperature was outside of the useful range for gravure until it was sufficiently heated to bring it within the gravure range. Higher temperatures would be needed to lower the viscosity of the composition even further.

EXAMPLE 2

In order to determine the effect temperature variations have on added solids (resins & emulsions), through the use of this invention, on the viscosity level of an aqueous coating and thus, the feasibility of using that coating in any printing application, a specific resinous composition comprising an acrylic methacrylic styrene copolymer was used. This composition was altered by the addition of solids and these newly formed compositions were exposed to varying temperatures.

(1) Preparation of the Aqueous Coating Composition with Additional Solids

Coating compositions having the following recipes were prepared as a coating liquid for application in all the printing processes.

| | | |
|---|---|---|
| (A) | Water | 81 grams |
| | Wetting Agent (same as Example 1) | 9 grams |
| | High Molecular Weight Polymer Emulsion Same as Example 1 | 105 grams |
| | Low Molecular Weight Polymer Solution Same as Example 1 | 135 grams |
| (B) | Water | 81 grams |
| | Wetting Agent (same as Example 1) | 9 grams |
| | High Molecular Weight Polymer Emulsion Same as Example 1 | 174 grams |

-continued

| | | |
|---|---|---|
| | Low Molecular Weight Polymer Solution Same as Example 1 | 135 grams |
| (C) | Water | 81 grams |
| | Wetting Agent (same as Example 1) | 9 grams |
| | High Molecular Weight Polymer Emulsion Same as Example 1 | 105 grams |
| | Low Molecular Weight Polymer Solution Same as Example 1 | 165 grams |
| (D) | Water | 81 grams |
| | Wetting Agent (same as Example 1) | 9 grams |
| | High Molecular Weight Polymer Emulsion Same as Example 1 | 150 grams |
| | Low Molecular Weight Polymer Solution Same as Example 1 | 165 grams |

The above coating compositions were prepared by agitating the mixtures of the above components in an electronic blender and agitating until thoroughly mixed.

(2) Temperature Variations & Viscosity Relationship

The various coating compositions were cooled and heated to determine the relationship between temperature, viscosity, and increased solids.

| Composition | Temp. (°F.) | Visc. (#3 Cup) | Visc. (#2 Cup) |
|---|---|---|---|
| A | 132° | 13 Sec. | 28 Sec. |
| | 83° | 25 Sec. | 67 Sec. |
| | 67° | 38 Sec. | 99 Sec. |
| B | 166° | 10 Sec. | 22 Sec. |
| | 160° | | 23 Sec. |
| | 140° | | 27 Sec. |
| | 120° | 15 Sec. | 38 Sec. |
| | 119° | 15 Sec. | |
| | 118° | | 38 Sec. |
| | 110° | 15 Sec. | |
| | 80° | 35 Sec. | 87 Sec. |
| C | 148° | | 24 Sec. |
| | 138° | 14 Sec. | |
| | 136° | | 24 Sec. |
| | 128° | 15 Sec. | |
| | 100° | 23 Sec. | 63 Sec. |
| | 82° | 38 Sec. | 100 Sec. |
| | 70° | 50 Sec. | 137 Sec. |
| | 60° | 66 Sec. | 176 Sec. |
| | 50° | 99 Sec. | 243 Sec. |
| D | 155° | | 26 Sec. |
| | 140° | | 42 Sec. |
| | 111° | 26 Sec. | 69 Sec. |
| | 70° | 90 Sec. | |

(3) Gloss Reflection Value & Solid Composition

Using the name techniques (tests) as above, the following gloss reflection values & solid compositions were obtained without affecting the mechanical transfer and the film formation properties and characteristics of the coatings.

(A) Gloss 82.3 High Solids 43%±2%

(B) Gloss 86.1 High Solids 47%±2%

(C) Gloss 88.5 High Solids 45%±2%

(D) Gloss 90.5 High Solids 50%±2%

(4) Conclusion

One may increase solids (both high and low molecular weight resins and/or emulsions), yet produce formulations which are in keeping with the present invention, in particular, the ability to provide workable viscosities having acceptable mechanical transfer for use in printing processes according to the present invention. It is noted that the useful offset range is 15 to 30 seconds with a #3 cup; the useful gravure range is 17 to 28 seconds with a #2 cup, and the useful flexography range is 20 to 60 seconds with a #2 cup evidencing that the present invention may be used in numerous printing processes to produce commercially viable results.

One may also increase gloss reflection value. Workable viscosity for use in printing processes may be managed through temperature control despite increased solids which would otherwise negatively impact mechanical transfer and take the composition out of workable mechanical application ranges desirable for use in the printing processes.

EXAMPLE 3

Experiment to determine the effect of maintaining the same temperature over a period of time on viscosity of aqueous coating compositions according to the present invention. Test compositions were those from Example 2, above. For each composition, the temperature was maintained for a period of time to determine whether or not it was possible to maintain the viscosity of a composition by maintaining the temperature.

(1) Aqueous Coating Compositions Used—Four Formulations as follows:

| | | |
|---|---|---|
| (A) | Water | 81 grams |
| | Wetting Agent (same as Example 1) | 9 grams |
| | High Molecular Weight Polymer Emulsion Same as Example 1 | 105 grams |
| | Low Molecular Weight Polymer Solution Same as Example 1 | 135 grams |
| (B) | Water | 81 grams |
| | Wetting Agent (same as Example 1) | 9 grams |
| | High Molecular Weight Polymer Emulsion Same as Example 1 | 174 grams |
| | Low Molecular Weight Polymer Solution Same as Example 1 | 135 grams |
| (C) | Water | 81 grams |
| | Wetting Agent (same as Example 1) | 9 grams |
| | High Molecular Weight Polymer Emulsion Same as Example 1 | 105 grams |
| | Low Molecular Weight Polymer Solution Same as Example 1 | 165 grams |
| (D) | Water | 81 grams |
| | Wetting Agent (same as Example 1) | 9 grams |
| | High Molecular Weight Polymer Emulsion Same as Example 1 | 150 grams |
| | Low Molecular Weight Polymer Solution Same as Example 1 | 165 grams |

The above coating compositions were prepared by agitating the mixtures of the above components in an electronic blender and agitating until thoroughly mixed.

(2) Temperature Maintenance & Viscosity Relationship

The various coating compositions were maintained at a constant temperature for 120 hours and the viscosity was checked every 6 hours in order to determine the relationship between temperature, viscosity and time.

| Composition | # Measurements | Temp. | Visc. (#3 or #2 cup) |
|---|---|---|---|
| A | 20 | 83° | 25 Sec. (#3) |
| | 20 | 132° | 28 Sec. (#2) |
| B | 20 | 120° | 15 Sec. (#3) |
| | 20 | 160° | 23 Sec. (#2) |
| C | 20 | 100° | 23 Sec. (#3) |
| | 20 | 136° | 24 Sec. (#2) |
| D | 20 | 111° | 26 Sec. (#3) |
| | 20 | 155° | 26 Sec. (#2) |

(3) Gloss & Solids

Same test as Example 2 gave same results a set forth in Example 2, as previously described.

Does not affect mechanical transfer or film formation characteristics of coatings.

(4) Conclusion

Maintaining the temperature of aqueous coatings according to the method of the present invention resulted in constant viscosity, even at high solid content. The result was mechanically workable solutions.

The present invention ameliorates concerns regarding changes in viscosity which often occur within 48 hours after the formulation is made and before the composition reaches an equilibrium (molecular structure of particles still in excitable state and not at equilibrium).

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

I claim:

1. A method for depositing an aqueous coating composition onto an ink layer or uninked surface in a printing process comprising:

1). Depositing a first layer of ink onto a surface to be coated;

2). Drying said ink layer;

3). Determining a desired viscosity of an aqueous coating composition to be deposited onto said ink layer or said surface, said composition comprising:

a. about 15% to about 85% by weight of a film-forming polymer, said film-forming polymer comprising a mixture of high molecular weight and low molecular weight film-forming polymers, said mixture of polymers comprising about 10% to about 90% by weight of a high molecular weight film-forming polymer and about 10% to about 90% by weight of a low molecular weight film-forming polymer, said high molecular weight film-forming polymer having an average molecular weight ranging from about 30,000 to about 5,000,000 and said low molecular weight having an average molecular weight ranging from about 100 to about 20,000;

b. an amount of a wetting agent effective to substantially eliminate levelling problems after deposition caused by surface tension; and c. the remainder of said composition comprising a mixture of water or water and at least one solvent in the form of a volatile organic compound;

4). Determining the temperature above or below ambient temperature at which said composition attains the viscosity determined in step 3);

5). Maintaining the viscosity of said composition at the temperature determined in step 4); and 6). Depositing onto said ink layer or said surface said aqueous coating composition at said temperature.

2. The method according to claim 1 wherein said temperature is maintained by a thermocouple.

3. The method according to claim 1 wherein said viscosity is determined electronically by a viscometer.

4. The method according to claim 1 wherein said composition is agititated to maintain uniform viscosity throughout said composition.

5. The method according to claim 1 wherein said low molecular weight film-forming polymer and said high molecular weight film-forming polymer each comprise at least about 10% by weight of said composition.

6. The method according to claim 1 wherein said wetting agent comprises about 0.005% to about 10% by weight of said composition.

7. The method according to claim 1 wherein said composition includes one agent selected from a mar resistant agent, a coalescing agent, a hardening agent, a plasticizing agent, a defoaming agent or mixtures thereof.

8. The method according to claim 1 wherein said solvent is water.

9. The method according to claim 1 wherein said film-forming polymer is a thermoset resin, a UV-cured resin or a thermoplastic resin.

10. The method according to claim 1 wherein said film-forming polymer is an acrylic resin or a styrene-acrylic resin.

11. A method for depositing an aqueous coating composition onto an ink layer or uninked surface in a wet-on-wet printing process comprising:

1). Depositing a first layer of hydrophobic ink onto a surface to be coated;

2). Determining a desired viscosity of an aqueous coating composition to be deposited onto said ink layer or said uninked surface, said composition comprising:

a. about 15% to about 85% by weight of a film-forming polymer, said film-forming polymer comprising a mixture of high molecular weight and low molecular weight film-forming polymers, said mixture of polymers comprising about 10% to about 90% by weight of a high molecular weight film-forming polymer and about 10% to about 90% by weight of a low molecular weight film-forming polymer, said high molecular weight film-forming polymer having an average molecular weight ranging from about 30,000 to about 5,000,000 and said low molecular weight having an average molecular weight ranging from about 100 to about 20,000;

b. an amount of a wetting agent effective to substantially eliminate levelling problems after deposition caused by surface tension; and c. the remainder of said composition comprising a mixture of water or water and at least one solvent in the form of a volatile organic compound;

3). Determining the temperature above or below ambient temperature at which said composition attains the viscosity determined in step 2);

4). Maintaining the viscosity of said composition at the temperature determined in step 3); and 5). Depositing onto said ink layer or said uninked surface said aqueous coating composition at said temperature.

12. The method according to claim 11 wherein said temperature is maintained by a thermocouple.

13. The method according to claim 11 wherein said viscosity is determined electronically by a viscometer.

14. The method according to claim 11 wherein said composition is agititated to maintain uniform viscosity throughout said composition.

15. The method according to claim 11 wherein said low molecular weight film-forming polymer and said high molecular weight film-forming polymer each comprise at least about 10% by weight of said composition.

16. The method according to claim 11 wherein said wetting agent comprises about 0.005% to about 10% by weight of said composition.

17. The method according to claim 11 wherein said composition includes one agent selected from a mar resistant agent, a coalescing agent, a hardening agent, a plasticizing agent, a defoaming agent or mixtures thereof.

18. The method according to claim 11 wherein said film-forming polymer is a thermoset resin, a UV-cured resin or a thermoplastic resin.

19. The method according to claim 11 wherein said film-forming polymer is an acrylic resin or a styrene-acrylic resin.

20. A process for enhancing the solids content of a dry-film produced in a printing process by depositing a high solids content aqueous coating composition onto an ink layer or uninked surface to instill favorable dry-film characteristics, including high gloss, comprising the steps of:

1). Preparing a high solids content aqueous coating composition for coating an ink layer or uninked surface in a printing process, said composition having a viscosity above a range useful in said process at ambient temperature, said composition comprising:

a. about 42% to about 85% by weight of a film-forming polymer, said film-forming polymer comprising a mixture of high molecular weight and low molecular weight film-forming polymers, said mixture of polymers comprising about 10% to about 90% by weight of a high molecular weight film-forming polymer and about 10% to about 90% by weight of a low molecular weight film-forming polymer, said high molecular weight film-forming polymer having an average molecular weight ranging from about 30,000 to about 5,000,000 and said low molecular weight having an average molecular weight ranging from about 100 to about 20,000;

b. an amount of a wetting agent effective to substantially eliminate levelling problems after deposition caused by surface tension; and c. the remainder of the composition comprising a mixture of water or water and at least one solvent in the form of a volatile organic compound;

2). Depositing a first layer of ink onto said uninked surface to be coated;

3). Determining a desired viscosity of said aqueous coating composition to be deposited onto said ink layer or said uninked surface;

4). Determining the temperature above ambient temperature at which said composition attains the viscosity determined in step 3);

5). Maintaining the viscosity of said composition at the temperature determined in step 4); and 6). Depositing onto said ink layer or uninked surface said aqueous coating composition at said set temperature.

21. The process according to claim 20 wherein said components a and b comprise at least about 50% by weight of said composition.

22. The method according to claim 20 wherein said composition is agititated to maintain uniform viscosity throughout said composition.

23. The method according to claim 20 wherein said temperature is maintained by a thermocouple.

24. The method according to claim 20 wherein said low molecular weight film-forming polymer and said high molecular weight film-forming polymer each comprise at least about 25% by weight of said formulation.

25. The method according to claim 20 wherein said wetting agent comprises about 0.005% to about 10% by weight of said composition.

26. The method according to claim 20 wherein said composition includes one agent selected from a mar resistant agent, a coalescing agent, a hardening agent, a plasticizing agent, a defoaming agent or mixtures thereof.

27. The method according to claim 20 wherein said film-forming polymer is a thermoset resin, a UV-curable resin or a thermoplastic resin.

28. The method according to claim 20 wherein said film-forming polymer is an acrylic resin or styrene-acrylic resin.

29. A process for coating an ink layer or uninked surface in a printing process using an aqueous coating composition containing less than about 5% by weight VOC's comprising the steps of:

1). Preparing an aqueous composition in the form of an composition containing no more than about 5% by weight VOC's comprising:

a. about 15% to about 85% by weight of a film-forming polymer, said film-forming polymer comprising a mixture of high molecular weight and low molecular weight film-forming polymers, said mixture of polymers comprising about 10% to about 90% by weight of a high molecular weight film-forming polymer and about 10% to about 90% by weight of a low molecular weight film-forming polymer, said high molecular weight film-forming polymer having an average molecular weight ranging from about 30,000 to about 5,000,000 and said low molecular weight having an average molecular weight ranging from about 100 to about 20,000;

b. an amount of a wetting agent effective to substantially eliminate levelling problems after deposition caused by surface tension; and c. the remainder of the composition comprising a mixture of water or water and at least one solvent in the form of a VOC, the amount of said solvent comprising no greater than about 5% by weight of said aqueous composition;

2). Determining a desired viscosity of said aqueous coating composition to be deposited onto said ink layer or said uninked surface;

3). Determining the temperature above or below ambient temperature at which said composition attains the viscosity determined in step 2);

4). Maintaining the viscosity of said composition at the temperature determined in step 3); and 5). Depositing onto said ink layer or said uninked surface said aqueous coating composition at said set temperature.

30. The method according to claim 29 wherein said temperature is maintained by a thermocouple.

31. The method according to claim 29 wherein said composition is agititated to maintain uniform viscosity throughout said composition.

32. The method according to claim 29 wherein said low molecular weight film-forming polymer and said high molecular weight film-forming polymer each comprise at least about 10% by weight of said-formulation.

33. The method according to claim 29 wherein said wetting agent comprises about 0.005% to about 10% by weight of said composition.

34. The method according to claim 29 wherein said composition includes one agent selected from a mar resistant agent, a coalescing agent, a hardening agent, a plasticizing agent, a defoaming agent or mixtures thereof.

35. The method according to claim 29 wherein said solvent is water.

36. The method according to claim 29 wherein said film-forming polymer is a thermoset resin, a UV-cured resin or a thermoplastic resin.

37. The method according to claim 29 wherein said film-forming polymer is an acrylic resin or styrene-acrylic resin.

38. A method of providing a barrier coating on a substrate for use in the food industry comprising:

1). Preparing a high solids content aqueous coating composition for deposition onto said substrate, said composition comprising about 42% to about 85% by weight of a film-forming polymer, said film-forming polymer comprising a high molecular weight film-forming polymer in an amount ranging from about 0% to about 99.995% by weight and a low molecular weight film-forming polymer in an amount ranging from about 0% to about 99.995% by weight, said high molecular weight film-forming polymer having an average molecular weight ranging from about 30,000 to about 5,000,000 and said low molecular weight having an average molecular weight ranging from about 100 to about 20,000, said film-forming polymer being included in said composition in an amount effective to produce a moisture-proof or oil proof barrier coating on said substrate after only one application;

2). Determining a desired viscosity of said aqueous coating composition to be deposited on said substrate;

3). Determining the temperature above ambient temperature at which said composition attains the viscosity determined in step 2);

4). Maintaining the viscosity of said composition at the temperature determined in step 3); and 5). Depositing onto said substrate said aqueous coating composition at said set temperature.

39. The method according to claim 38 wherein said temperature is maintained by a thermocouple.

40. The method according to claim 38 wherein said film-forming polymer is a mixture of a low molecular weight film-forming polymer and a high molecular weight film-forming polymer each comprising at least about 10% by weight of said composition.

41. The method according to claim 38 wherein said substrate is paperboard.

42. The method according to claim 38 wherein said high or low molecular weight film-forming polymer is an acrylic resin.

* * * * *

UNITED STATES PATENT AND TRADEMARK OFFICE

CERTIFICATE OF CORRECTION

PATENT NO. : 5,384,160

DATED : January 24, 1995

INVENTOR(S) : Joseph Frazzitta

It is certified that error appears in the above-indentified patent and that said Letters Patent is hereby corrected as shown below:

Delete the abstract and insert the following abstract:

--The present invention relates to a novel method for the deposition of aqueous coating compositions in printing processes including wet-trap in-line, off-line dry-trap, gravure, offset (using water and waterless), silk-screen, flexography and related printing processes. Use of the present invention results in the adaptation of an aqueous coating to a printing method without the need to change the chemical content of that formulation. In this method, an aqueous coating's viscosity is determined and adjusted to that value by raising or lowering the temperature of the coating above or below ambient temperature. In certain embodiments, use of the present invention produces unexpectedly high levels of solid being incorporated into printing coating compositions for obtaining levels of gloss on surfaces which previously have been unobtainable. In another embodiment, an aqueous coating composition containing low VOC's or even an absence of VOC's can be generally adapted to a number of printing methods to provide exceptionally favorable transfer, especially including high gloss value.--

Column 4, line 66, change "ink" to --inked--.

Column 16, line 63, delete "a" (first occurrence).

Column 19, line 47, change "name" to --same--.

Column 21, claim 1, line 42, insert --film-forming polymer-- after "weight".

Column 22, claim 11, line 38, insert --film-forming polymer-- after "weight".

UNITED STATES PATENT AND TRADEMARK OFFICE

CERTIFICATE OF CORRECTION

PATENT NO. : 5,384,160

DATED : January 24, 1995

INVENTOR(S) : Joseph Frazzitta

It is certified that error appears in the above-indentified patent and that said Letters Patent is hereby corrected as shown below:

Column 23, claim 20, line 35, insert --film-forming polymer-- after "weight"; claim 24, line 68, change "formulation" to --composition--.

Column 24, claim 29, line 20, change "an" to --a--; line 33, insert --film-forming polymer-- after "weight".

Column 25, claim 38, line 26, insert --film-forming polymer-- after "weight".

Signed and Sealed this

Twenty-seventh Day of June, 1995

*Attest:*

*Attesting Officer*

BRUCE LEHMAN

*Commissioner of Patents and Trademarks*